US012359898B2

(12) United States Patent
Weidemann

(10) Patent No.: US 12,359,898 B2
(45) Date of Patent: Jul. 15, 2025

(54) RIFLE CARTRIDGE AND RIFLE BULLET

(71) Applicant: Hermann Arthur Weidemann, Gilbert, AZ (US)

(72) Inventor: Hermann Arthur Weidemann, Gilbert, AZ (US)

( * ) Notice: Subject to any disclaimer, the term of this patent is extended or adjusted under 35 U.S.C. 154(b) by 0 days.

(21) Appl. No.: 17/622,736

(22) PCT Filed: Jun. 24, 2020

(86) PCT No.: PCT/IB2020/055963

§ 371 (c)(1),
(2) Date: Dec. 24, 2021

(87) PCT Pub. No.: WO2020/261136

PCT Pub. Date: Dec. 30, 2020

(65) Prior Publication Data

US 2022/0163299 A1 May 26, 2022

Related U.S. Application Data

(60) Provisional application No. 62/867,119, filed on Jun. 26, 2019.

(51) Int. Cl.
*F42B 10/38* (2006.01)
*F42B 5/02* (2006.01)

(52) U.S. Cl.
CPC ..... *F42B 5/02* (2013.01); *F42B 10/38* (2013.01)

(58) Field of Classification Search
CPC .. F42B 5/02; F42B 10/22; F42B 10/24; F42B 14/02; F42B 10/38–46
See application file for complete search history.

(56) References Cited

U.S. PATENT DOCUMENTS

| | | | | | |
|---|---|---|---|---|---|
| 484,008 | A * | 10/1892 | Haskell | F42B 14/02 | 102/524 |
| 1,659,625 | A * | 2/1928 | Cowan | F42B 5/02 | 42/78 |
| 2,356,227 | A | 8/1944 | Stanley | | |
| 2,559,955 | A | 7/1951 | Hartwell | | |
| 3,301,186 | A | 1/1967 | Henry | | |
| 4,996,924 | A * | 3/1991 | McClain | F42B 10/24 | 102/438 |
| 5,164,538 | A | 11/1992 | McClain | | |
| 6,679,178 | B2 | 1/2004 | Mihaylov et al. | | |
| 10,989,507 | B2 * | 4/2021 | Thompson | F42B 10/24 | |
| 11,333,472 | B1 * | 5/2022 | Peterson | F42B 12/74 | |
| 2002/0134273 | A1 * | 9/2002 | Mihaylov | F42B 14/04 | 102/439 |

(Continued)

FOREIGN PATENT DOCUMENTS

GB 470250 A 8/1937

OTHER PUBLICATIONS

PCT/IB2020/055963 International Search Report and Written Opinion dated Apr. 28, 2021, 9 pages.

*Primary Examiner* — Jonathan C Weber
(74) *Attorney, Agent, or Firm* — Clark Hill, PLC

(57) ABSTRACT

A bullet, having a longitudinal body on which is defined a set of radially spaced, longitudinally extending helical grooves corresponding to the rifling of a particular barrel and at least one circumferential drive band which intersects the set of helical grooves, to define a pressure retaining formation with a casing of a cartridge, in use.

20 Claims, 7 Drawing Sheets

(56) References Cited

U.S. PATENT DOCUMENTS

| | | | | |
|---|---|---|---|---|
| 2007/0074637 | A1* | 4/2007 | Pontieri | F42B 10/24<br>102/524 |
| 2015/0354932 | A1 | 12/2015 | Schnabel | |
| 2016/0327380 | A1* | 11/2016 | Kunz | F42B 10/44 |
| 2020/0116463 | A1* | 4/2020 | Harrison | F42B 10/38 |
| 2020/0240758 | A1* | 7/2020 | Thompson | F42B 10/24 |

* cited by examiner

RIFLE CARTRIDGE AND RIFLE BULLET

FIELD OF THE INVENTION

This invention relates to a bullet and to a bullet cartridge.

BACKGROUND OF THE INVENTION

Bullet design is influenced by various factors, each of which has a particular influence on bullet performance.

In this specification a bullet body is defined to comprise a tip (meplat), an ogive, a cylindrical part (bearing surface) and a base (which may include a boattail).

This invention addresses two factors of bullet design namely reducing energy loss in the barrel caused by mechanical friction and maintaining bullet stability during flight.

Various factors have an influence on bullet stability namely the rate of rotation, the material density of the bullet, the length of the bullet, the mass of the bullet and the destabilizing yaw moment the bullet experiences during flight, caused by the center of pressure being located ahead of the center of gravity.

In order to impart gyroscopic stability to a bullet during flight, rifle barrels are manufactured with internal helical rifling with a predefined twist rate, such as one revolution in 8 inches (1:8), one turn in ten inches (1:10), or the like. Bullets are manufactured to a particular barrel caliber. The length and mass of the bullet determine the barrel twist requirement.

Traditional jacketed bullets have a smooth outer bearing surface that matches the outer groove diameter of the barrel. Once the bullet starts to travel through the bore of the barrel, the bearing surface is engraved according to the rifling of the barrel. This action causes rotational torque on the bullet thereby to impart spin to the bullet which stabilizes the bullet gyroscopically during flight. When fired and engaging the barrel rifling, the bearing surface of a bullet expands slightly due to the displaced material from the engraving process to form a seal with the internal dimensions of the barrel. The process of cutting the grooves into the bearing surface and the expansion of the bearing surface to form a seal with the internal dimensions of the barrel causes in-bore friction and therefore loss of potential kinetic energy in the bullet.

It is an object of this invention to mechanically engage the bullet with the barrel rifling prior to the discharge of the firearm and thereby facilitate precisely repeatable bullet spin-up, increased gyroscopic stability, which will enhance accuracy, while simultaneously minimizing in-bore friction and converting the reduced engraving loss into increased muzzle velocity, kinetic energy and thus range.

SUMMARY OF THE INVENTION

According to a first aspect of the invention, there is provided a bullet, having a longitudinal body on which is defined

- a set of radially spaced, longitudinally extending helical grooves corresponding to the rifling of a particular barrel; and
- at least one circumferential drive band which intersects the set of helical grooves, to define a pressure retaining formation with a casing of a cartridge, in use.

The bullet may define at least two longitudinally spaced circumferential drive bands each of which that intersects the set of helical grooves, to define the pressure retaining formation (seals) with the casing of a cartridge, in use. In this specification the terms circumferential drive band, circumferential seal, pressure seal and pressure retaining formation are used interchangeably and refers to the same formations on the bullet.

The helical grooves may extend at least partially over the length of the bullet.

The helical grooves may extend from the ogive, over the bearing surface of the cylindrical part and at least partially towards the base of the bullet. The helical grooves, extending forward toward the ogive and rearward toward the boattail may transitionally diminish in depth as the ogive and boattail diameters reduce towards the front and the rear of the bullet.

It is to be appreciated that the spacing, angularity and shape of the helical grooves are matched with the rifling of a particular barrel.

A rear drive band of the at least two drive bands may be positioned on the bullet to correspond to a position proximate a base of the neck of a cartridge case.

A front drive band of the at least two drive bands may be positioned on the bullet to correspond to a position proximate an opening (mouth) of the cartridge case.

The bullet may include additional longitudinally spaced circumferential drive bands spaced between the at least two longitudinally spaced circumferential drive bands.

In one embodiment the diameter of the cylindrical part of the bullet body may define the groove diameter of the bullet. In this embodiment, the at least two longitudinally spaced circumferential drive bands are defined only by circumferential seals intersecting the set of helical grooves. Upon encountering the barrel rifling, the displaced material will enlarge the circumference of the bullet sufficiently to seal off propellant gasses.

In another embodiment the cylindrical part of the bullet body and the base of the ogive may have a minimally reduced diameter in relation to the diameter of the at least one drive band defining the outer diameter of the bullet. Typically the drive band diameter may be increased by between 0% and 2% of the cylindrical part of the bullet body. The cylindrical part of the bullet body defining the groove diameter.

According to another aspect of the invention, there is provided a cartridge, which includes

- a bullet, having a longitudinal body on which is defined
  - a set of radially spaced, longitudinally extending helical grooves corresponding to the rifling of a particular barrel;
  - at least one circumferential drive band that intersects the set of helical grooves, to define a pressure retaining formation with a casing of a cartridge, in use; and
- a case to which the bullet is fitted.

The cartridge may include a primer.

The cartridge may include a powder charge.

In use, the longitudinally extending helical grooves engage the barrel rifling during loading of the cartridge into the chamber. Upon firing, propellant gas push the bullet body through the barrel rifling with the at least one circumferential drive band material that intersects the helical grooves being displaced to seal off bypassing gas to create the safe operating pressure.

The invention will now be described by way of a non-limiting example only, with reference to the following drawings.

DRAWINGS

EMBODIMENT OF THE INVENTION

Figure 1:
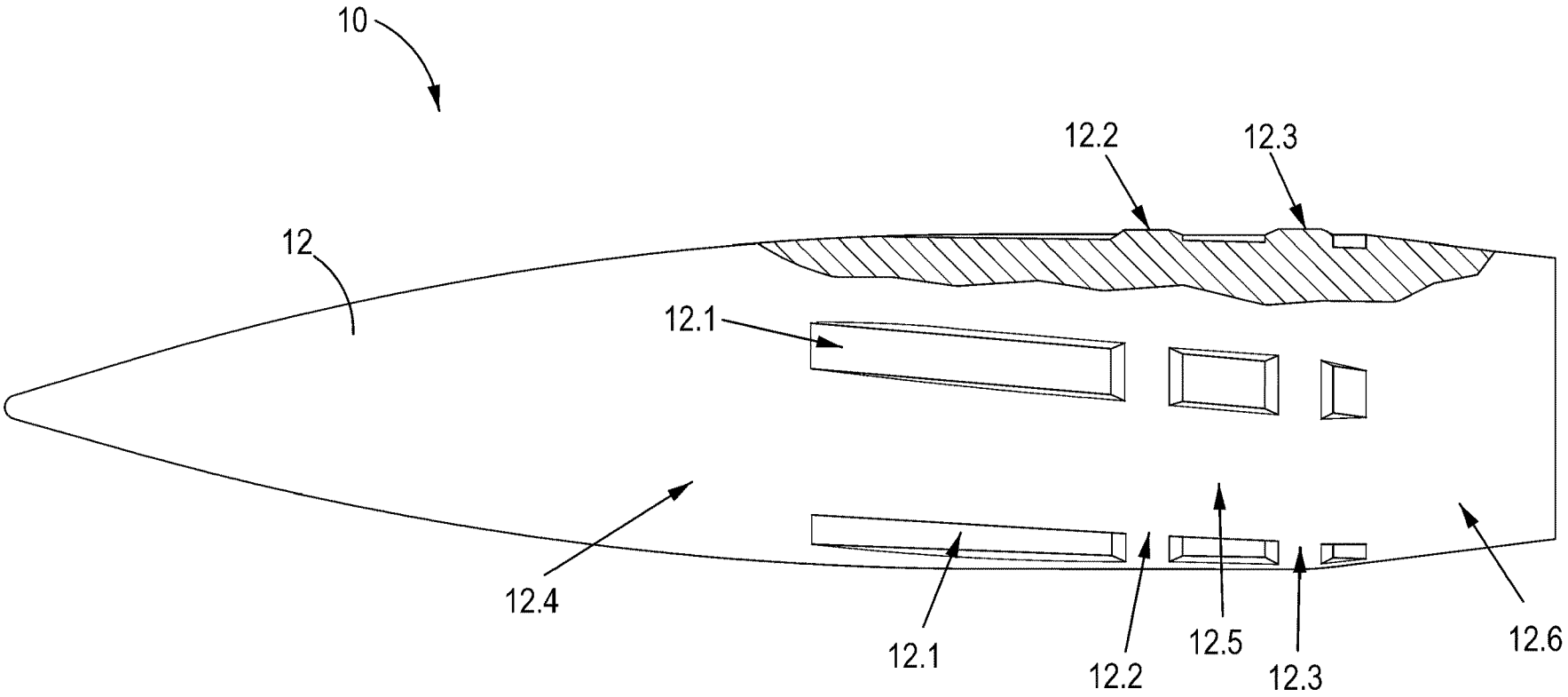
FIGS. 1 and 2 show a bullet in accordance with a first embodiment of the invention.

In FIG. 1 reference numeral (10) refers to a bullet having a longitudinal body (12). The body has a set of radially spaced, longitudinally extending helical grooves (12.1) corresponding to the left-hand or right-hand twisted rifling of a particular barrel and two longitudinally spaced circumferential drive bands (12.2, 12.3) each of which that intersects the set of helical grooves (12.1), to define a pressure retaining formation with a casing (50) of a cartridge, in use before firing (see FIG. 2), and with a barrel (not shown) of a rifle, after firing. It is to be appreciated that the grooves correspond with the rifling in the barrel of a particular firearm. FIG. 1 shows a part sectional portion from the side (shaded area).

Figure 2:
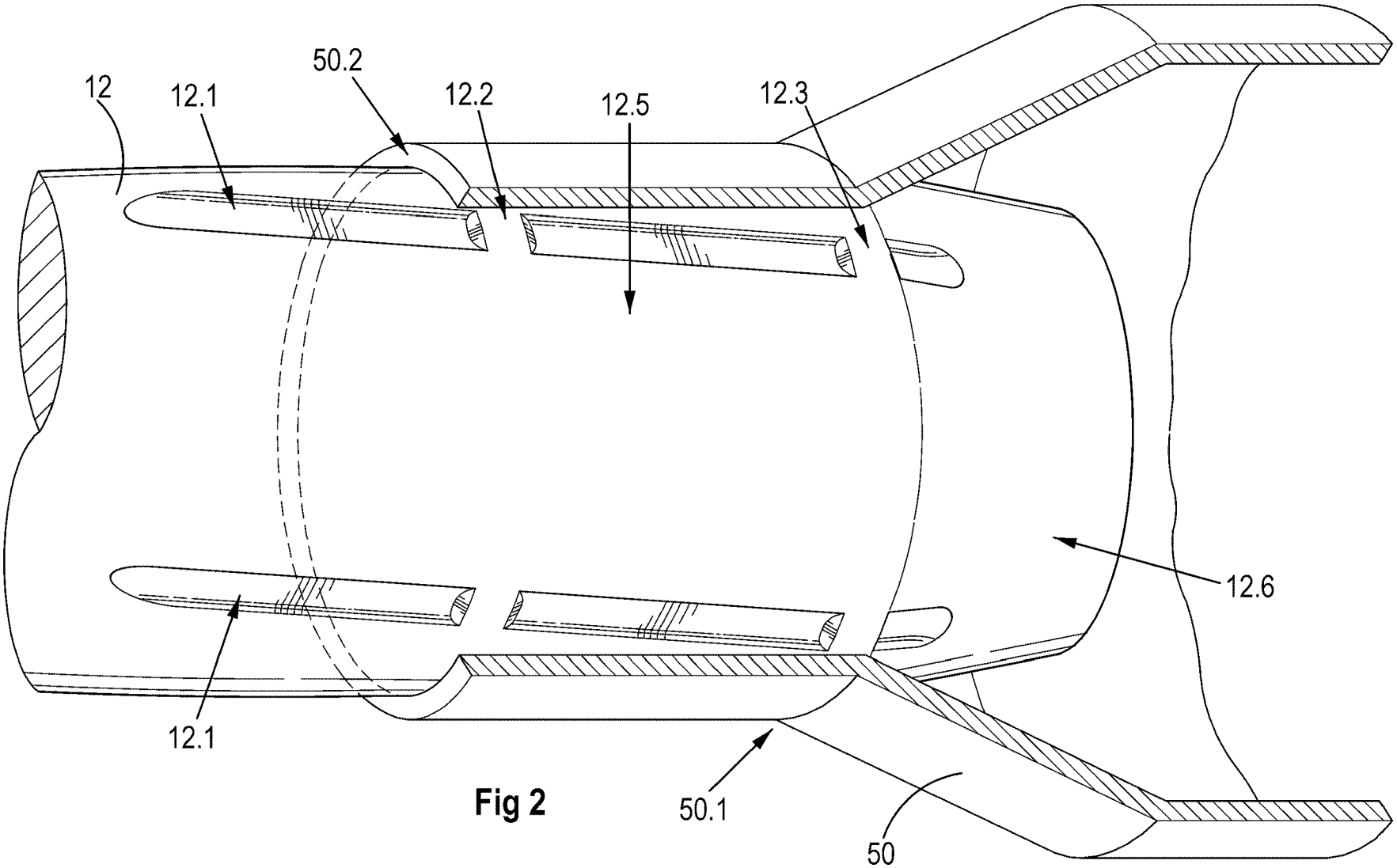

As can be seen the helical grooves (12.1) extend partially over the length of the bullet from a rear part of an ogive (12.4) of the bullet body (12) over the bearing surface (12.5) of cylindrical part of the bullet body (12) towards the base of the bullet body (12) at a front portion of a boattail (12.6). As is clearly visible in FIG. 1, the helical grooves (12.1), extending forward toward the ogive (12.4) and rearward toward the boattail (12.6) transitionally diminish in depth as the ogive- and boattail diameters reduce towards the front and the rear of the bullet. As can be seen in the drawings, the grooves are slightly helical in shape corresponding to left-handed or right-handed twist in a matching barrel, and not aligned with the longitudinal axis of the bullet body (12). As can be seen in FIG. 2, the circumferential drive bands (12.2, 12.3) are spaced apart about one caliber, which normally defines the length of the case neck.

It is to be appreciated that the bullet (10) may be machined to create a meplat (not shown in FIG. 2), an ogive (12.4), a cylindrical body (12.5) and a boat tail (12.6) or a flat (not shown) rear end (base). Different embodiments of the invention may be manufactured by means of known metal working processes, such as computer numerical control (CNC) machining, swaging, forging, pressing or rolling, or even additive manufacturing processes such as 3D printing.

As can be seen in the embodiment shown in FIG. 1, the circumferential drive bands (12.2, 12.3) are flush with the bearing surface (12.5) of the cylindrical part of the bullet body (12) and are only visible where they intersect the helical grooves (12.1). Indeed, it can be imagined that the circumferential drive bands (12.2, 12.3) are only sections where the helical grooves (12.1) are not cut out. In this example the diameter of the cylindrical part of the bullet body (12) corresponds with the largest diameter of the barrel (not shown). Importantly, as set out above, the spacing and shape of the helical grooves are matched with the rifling of a particular barrel design.

As can more clearly seen in FIG. 2, the rear drive band (12.3) of the two drive bands is positioned on the bullet body (12) to correspond to a position proximate a base of the neck (50.1) of the cartridge case (50). The front drive band (12.2) of the two drive bands is positioned on the bullet body (12) to correspond to a position proximate a mouth (50.2) of the cartridge case (50).

Figure 3:
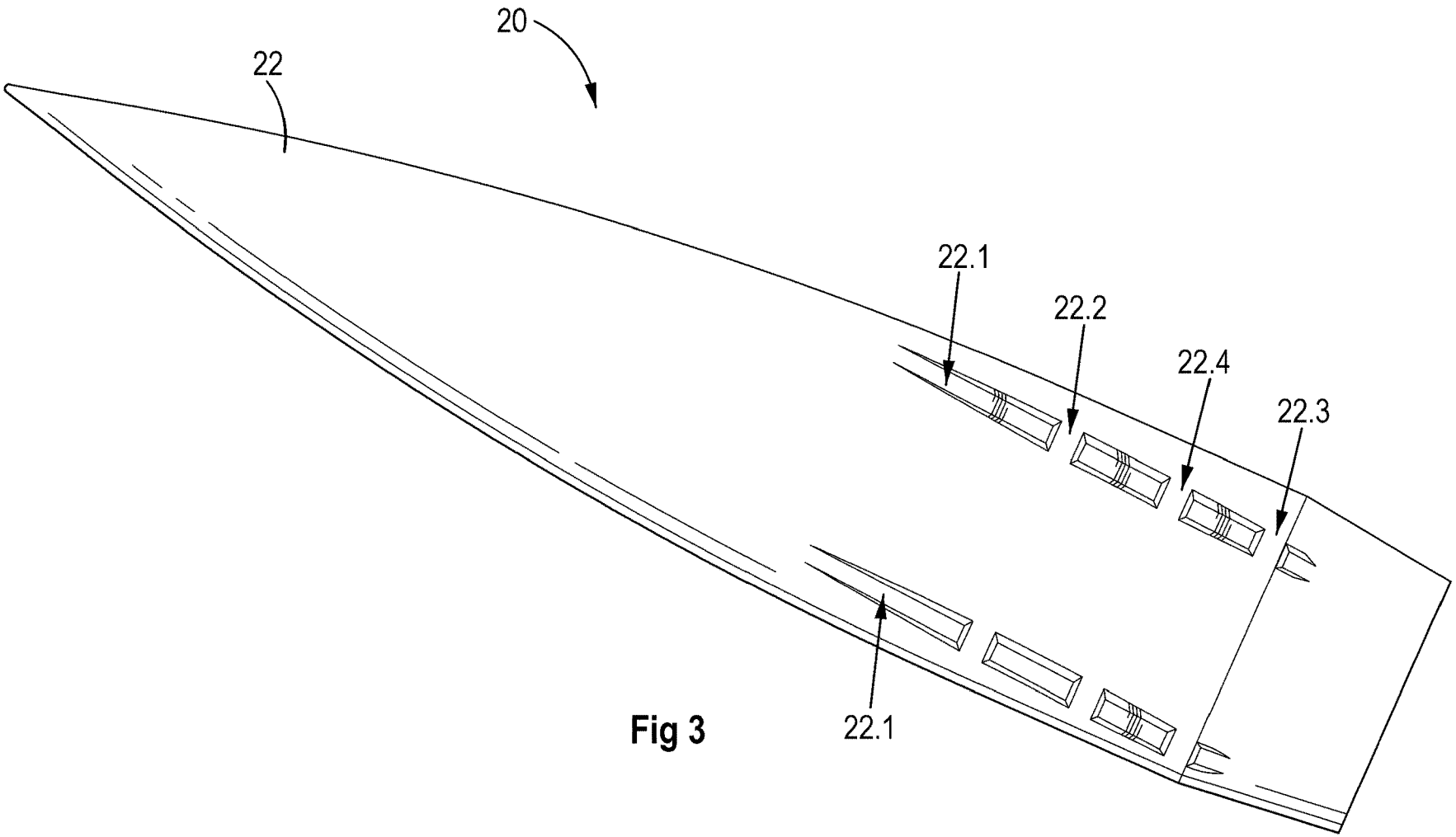
FIG. 3 shows the embodiment of FIGS. 1 and 2 with an additional circumferential drive band.

FIG. 3 shows the embodiment of the bullet (10) of FIGS. 1 and 2 but where the bullet (20) has a bullet body (22) and a set of radially spaced, longitudinally extending helical grooves (22.1) corresponding to the rifling of a particular barrel and two longitudinally spaced circumferential drive bands (22.2, 22.3) each of which that intersects the set of helical grooves (12.1), to define a pressure retaining formation with a casing (not shown) of a cartridge, in use, and with a barrel (not shown) of a rifle, after firing. In this example, an additional circumferential drive band (22.4) is located between the drive bands (22.2, 22.3). Additional circumferential drive band examples beyond the three-count are inferred but not shown.

Figure 4:
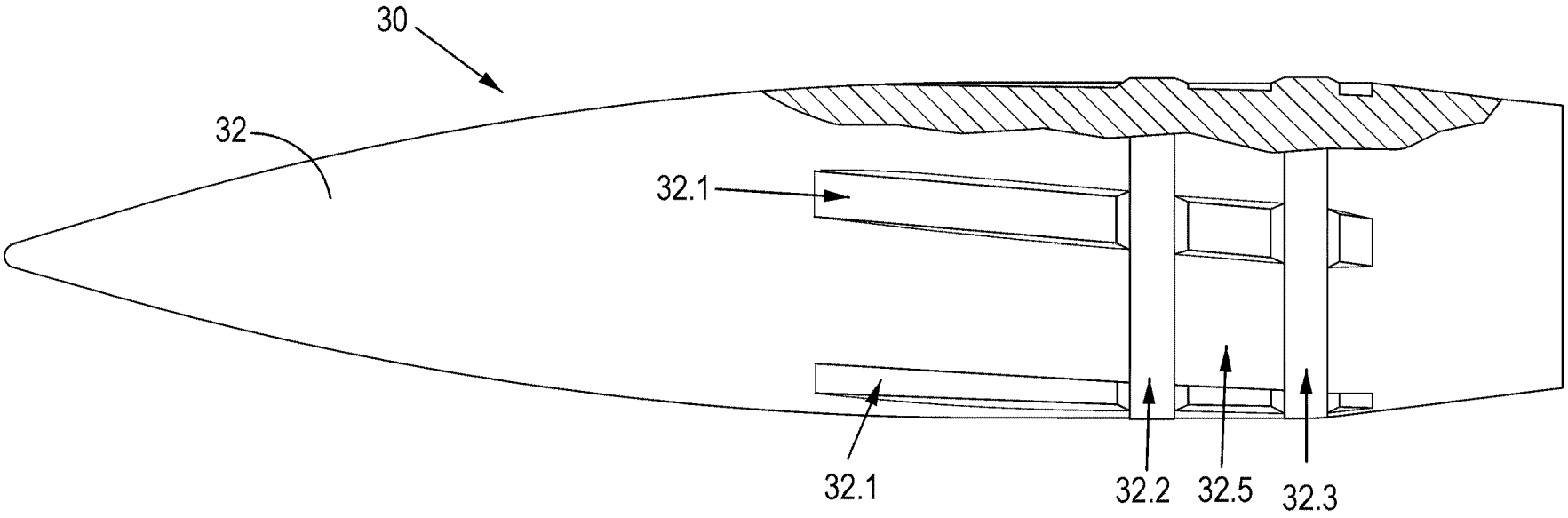
FIGS. 4 and 5 show a second embodiment of the invention.
Figure 5:
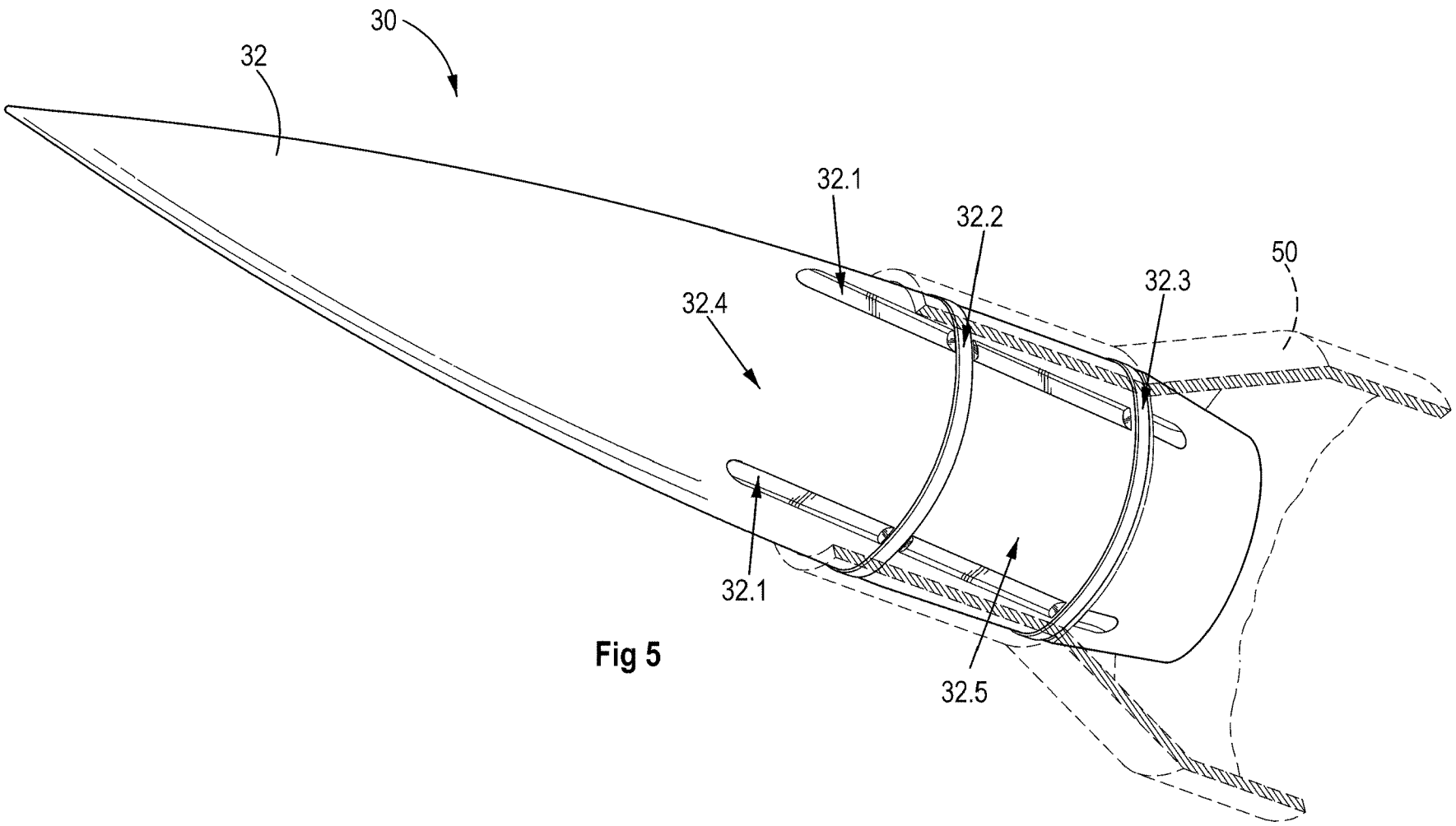

FIGS. 4 and 5 show a second embodiment of the invention, where a bullet (30) has a bullet body (32) and a set of radially spaced, longitudinally extending helical grooves (32.1) corresponding to the rifling of a particular barrel and two longitudinally spaced circumferential drive bands (32.2, 32.3) each of which intersects the set of helical grooves (32.1), to define a pressure retaining formation with a casing (not shown) of a cartridge, in use. In this example the drive bands (32.2, 32.3) are visible as the drive bands (32.2, 32.3) have a slightly increased diameter over the bearing surface (32.5) of cylindrical part of the bullet body (32). Advantageously, the slightly increased diameter of the drive bands (32.2, 32.3) and the slightly decreased cylindrical part (32.5) of the body reduces the effect of friction and therefore the concomitant production of heat in the barrel.

As can be seen in FIG. 5, the bullet (30) is shown mounted in a case 50 (shown in broken line). As can be seen the bullets (30) in FIGS. 4 and 5 have slightly different spacing of the drive bands 32.2 and 32.3.

Figure 6:
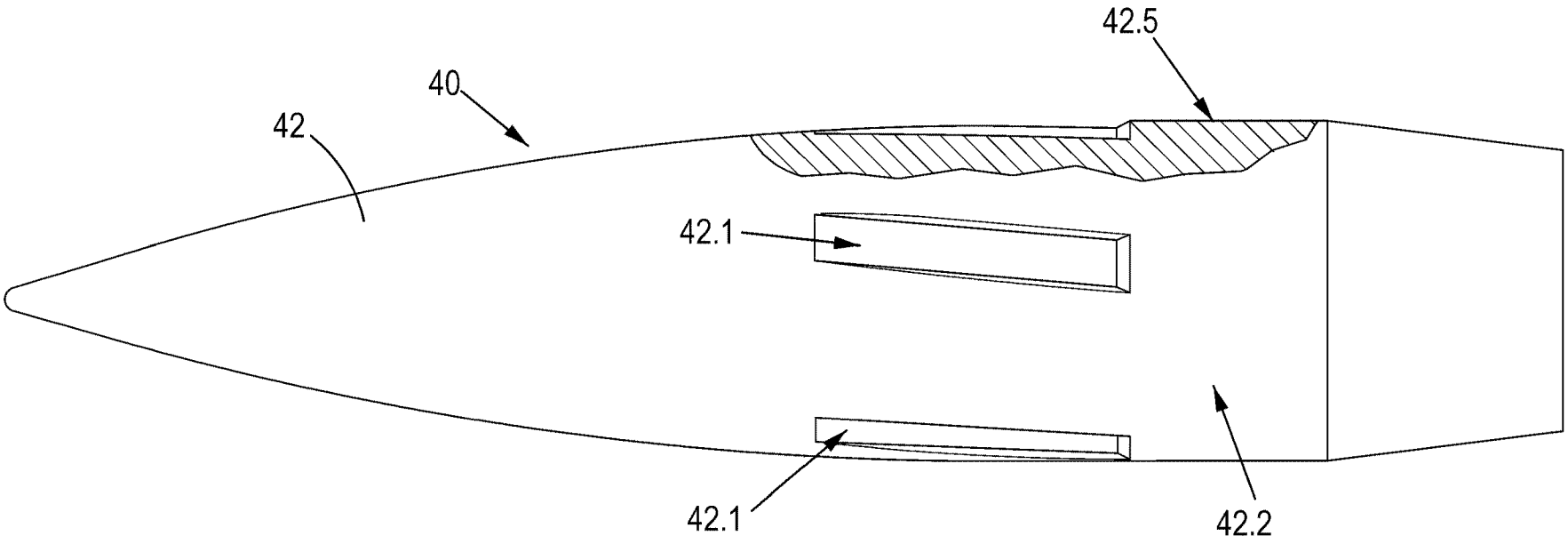
FIG. 6 shows a third embodiment of the invention.

In FIG. 6 another embodiment of the invention is shown where a bullet (40) has a bullet body (42) and a set of radially spaced, longitudinally extending helical grooves (42.1) corresponding to the rifling of a particular barrel and a single circumferential drive band (42.2) which intersects the set of helical grooves (42.1), to define a pressure retaining formation (seal) with a casing (not shown) of a cartridge, in use, and with a barrel (not shown) of a rifle, after firing. As can be seen the part sectional view of FIG. 6, the single circumferential drive band (42.2) is flush with and part of the cylindrical portion of the bullet (40). Indeed, it can be imagined that the pressure seal (42.2), is the section where the helical grooves (42.1) are not cut out.

Figure 7:
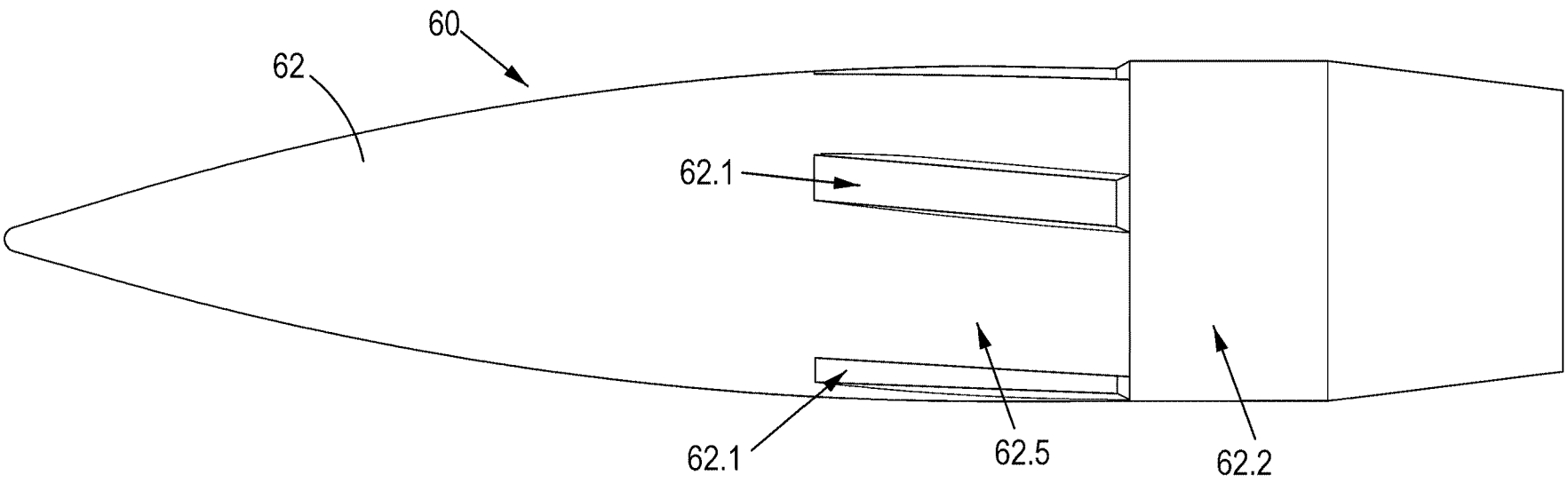
FIG. 7 shows a fourth embodiment of the invention.

In FIG. 7 another embodiment of the invention is shown where a bullet (60) has a bullet body (62) and a set of radially spaced, longitudinally extending helical grooves (62.1) corresponding to the rifling of a particular barrel and a single circumferential drive band (62.2) which intersects the set of helical grooves (62.1), to define a pressure retaining formation with a casing (not shown) of a cartridge, in use, and with a barrel (not shown) of a rifle, after firing. As can be seen the part sectional view of FIG. 6, the single circumferential drive band (62.2) has a slightly increased diameter (plus up to 2%) relative to the cylindrical portion (62.5) of the bullet (60).

In use, a cartridge is manually placed in a chamber with the grooves (12.1, 22.1, 32.1, 42.1, 60.1) engaging the ridges (not shown) of the barrel rifling (not shown), where after the bolt is closed. The design of the loaded cartridge is such, that the bolt cannot be closed unless the helical grooves (12.1, 22.1, 32.1, 42.1, 60.1) of the bullet (10, 20, 30, 40, 60) are mated with the barrel rifling. When the rifle is fired, the pressure in the case from the propellant gas unseats the bullet from the neck of the case (50) and causes the bullet (10, 20, 30, 40, 60) to accelerate within the barrel and to rotate along the twist of the barrel rifling. The cylindrical part of the bullet body (12, 22, 32, 42, 62), along with the helical grooves (12.1, 22.1, 32.1, 42.1, 60.1) align the bullet (10, 20, 30, 40, 60) longitudinally within the barrel.

The longitudinal movement of the circumferential drive bands (12.2, 12.3; 22.2, 22.3, 22.4; 32.2, 32.3; 42.2; 62.2) of the bullet (10, 20, 30, 40, 60) onto the ridges of the barrel causes the circumferential drive band (12.2, 12.3; 22.2, 22.3, 22.4; 32.2, 32.3; 42.2; 62.2) material to be displaced. This displacement causes the bullet body (12, 22, 32, 42, 62) to bulge, thereby to create a tight seal against the barrel rifling and groove surfaces, thereby to prevent propellant gas from bypassing the bullet body (12, 22, 32, 42, 62). As can be seen in the Figures, the helical grooves (12.1, 22.1, 32.1, 42.1, 60.1) are provided with a ramped angled transition where they meet the circumferential pressure bands (12.2, 12.3; 22.2, 22.3, 22.4; 32.2, 32.3; 42.2; 62.2), which provides a more gradual engraving from the ridges of the barrel and facilitates the forming of the radial bulge profile.

As the rear end of the helical grooves engages the rifling, the bullet is now in full engagement with the bore and the circumferential drive bands (12.2, 12.3; 22.2, 22.3, 22.4; 32.2, 32.3; 42.2; 62.2) seal the bullet (10, 20, 30, 40, 60) over the grooves and cross-sectional rifling geometry in the barrel to restrict any pressure losses as the bullet (10, 20, 30, 40, 60) travels down the barrel towards the muzzle.

It is to be appreciated that the particular twist rate of the barrel rifling and the number of grooves of a particular barrel will determine the specific design of the helical grooves (12.1, 22.1, 32.1, 42.1, 60.1) on the bullet (10, 20, 30, 40, 60). This invention can equally be applied to right hand and left hand twists. Furthermore, the invention can be equally applied to the shape of the rifling, whether it is U-shaped, rectangular, trapezoidal or another geometrical design.

It is to be appreciated that the bullets (10, 20, 30, 40, 60) can be manufactured of a mono metal, a jacketed bullet, or the like.

The inventor believes that the invention provides a new bullet and cartridge which minimizes in-bore friction, minimizes pressure losses and therefore reduce resultant kinetic energy loss without reduction in bullet stability.

The invention claimed is:

1. A rifle cartridge, comprising:

a cartridge case; and a rifle bullet that fits within the cartridge case, the rifle bullet having:

a longitudinal body comprised of an ogive-shaped front portion having a diameter that diminishes towards a front end of the bullet, a substantially cylindrical-shaped center portion, and a boattail-shaped rear portion including a tapered tail portion having a diameter that diminishes towards a rear end of the bullet, the cylindrical-shaped center portion having a diameter equivalent with a groove diameter of a particular rifle barrel, the cylindrical part extending between the ogive-shaped front portion and the boattail-shaped rear portion of the longitudinal body;

a set of radially spaced, longitudinally extending helical grooves that match rifling of the barrel, the helical grooves extending at least partially over the length of the bullet, including in a rear part of ogive of the longitudinal body, in a bearing surface of the cylindrical part of the longitudinal body and at least partially in the boattail-shaped rear portion of the longitudinal body, the helical grooves diminishing in depth towards the front of the bullet as the diameter of the ogive reduces towards the front of the bullet; and at least one circumferential drive band being longitudinally positioned around the cylindrical-shaped center portion and having a same diameter as the cylindrical-shaped center portion, and which intersects the set of helical grooves, to define a pressure retaining formation when used with the cartridge case.

2. The rifle cartridge of claim 1, the longitudinal body of the rifle bullet having at least two longitudinally spaced circumferential drive bands each of which intersects the set of helical grooves in the rifle bullet, to define the pressure retaining formation.

3. The rifle cartridge of claim 2, wherein a rear drive band of the at least two drive bands is positioned on the bullet to correspond to a position proximate a base of a neck of the cartridge case.

4. The rifle cartridge of claim 2, wherein a front drive band of the at least two drive bands is positioned on the bullet to correspond to a position proximate an opening of the cartridge case.

5. The rifle cartridge of claim 2, the longitudinal body of the rifle bullet having one or more additional longitudinally spaced circumferential drive bands spaced between the at least two longitudinally spaced circumferential drive bands.

6. The rifle cartridge of claim 1, wherein spacing, shape and angularity of the helical grooves in the rifle bullet match with rifling of the particular barrel.

7. The rifle cartridge of claim 1, wherein an outer diameter of the cylindrical part of the longitudinal body of the rifle bullet defines a groove diameter of the barrel.

8. The rifle cartridge of claim 7, in which the at least one circumferential drive band of the rifle bullet is defined by circumferential seals equal to a groove diameter of the barrel, intersecting the set of helical grooves in the rifle bullet.

9. The rifle cartridge of claim 1, wherein a cylindrical part of the longitudinal body and a base of the ogive-shaped front portion defines an outer diameter of the bullet with the diameter of the at least one drive band of the rifle bullet being slightly increased to match the groove diameter of the barrel.

10. The rifle cartridge of claim 9, in which the at least one drive band of the rifle bullet has a diameter increased by between 0% and 2% of the cylindrical part.

11. The rifle cartridge of claim 1, wherein:

the longitudinal body defines at least two longitudinally spaced circumferential drive bands each of which intersects the set of helical grooves to define pressure retaining seals in use with the casing of a cartridge, the helical grooves extending from a rear part of the ogive of the longitudinal body over a bearing surface of its cylindrical part at least partially in the boattail-shaped rear portion of the longitudinal body, the helical grooves diminishing in depth towards the front of the bullet as the diameter of the ogive reduce towards the front of the bullet, wherein spacing, angularity and shape of the helical grooves match with the rifling of the particular barrel, the two longitudinally spaced circumferential drive bands being spaced apart approximately the length of a case neck.

12. The rifle cartridge of claim 1, further comprising: a primer and a powder charge; and wherein (a) the longitudinally extending helical grooves of the rifle bullet engage the barrel rifling during loading of the cartridge into the chamber, and (b) upon firing, propellant gas pushes the bullet body through the barrel rifling with the at least one circumferential drive band material intersecting the helical grooves displaced by the barrel rifling to seal off bypassing gas to create safe operating pressure.

13. The rifle cartridge of claim 1, wherein the barrel rifling enlarges a circumference of the at least one circumferential drive band of the rifle bullet to seal the rifle bullet to an outer facing edge defined by a groove diameter of the barrel to thereby seal off flow of propellant gases expelled from the cartridge case.

14. The rifle cartridge of claim 1, wherein the at least one circumferential drive band has a diameter that is greater than 0% and less than or equal to 2% of a diameter of the cylindrical-shaped center portion of the rifle bullet yet equal to the groove diameter of the barrel, to enlarge the circumference of the bullet sufficiently to seal off propellant gases to expel the rifle bullet from the cartridge case.

15. A rifle bullet that fits within a cartridge case, the rifle bullet comprising:

a longitudinal body comprised of an ogive-shaped front portion having a diameter that diminishes towards a front end of the bullet, a substantially cylindrical-shaped center portion, and a boattail-shaped rear portion including a tapered tail portion having a diameter that diminishes towards a rear end of the bullet, the cylindrical-shaped center portion having a diameter equivalent with a groove diameter of a particular rifle barrel, the cylindrical part extending between the ogive-shaped front portion and the boattail-shaped rear portion of the longitudinal body;

a set of radially spaced, longitudinally extending helical grooves that match rifling of the barrel, the helical grooves extending at least partially over the length of the bullet, including in a rear part of the ogive of the longitudinal body, in a bearing surface of the cylindrical part of the longitudinal body and at least partially in the boattail-shaped rear portion of the longitudinal body, the helical grooves diminishing in depth towards the front of the bullet as the diameter of the ogive reduces towards the front of the bullet; and at least one circumferential drive band being longitudinally positioned around the cylindrical-shaped center portion and having the same diameter as the cylindrical part, which intersects the set of helical grooves to define a pressure retaining formation when used with the cartridge case.

16. The rifle bullet of claim 15, in which the spacing of the drive bands corresponds to the length of a cartridge case neck.

17. The rifle bullet of claim 15, in which a forward portion of the cylindrical part of the longitudinal body has a reduced diameter of between 0% and 2% less than the diameter of the at least one circumferential drive band.

18. The rifle bullet of claim 15, wherein the longitudinal body of the rifle bullet has at least two longitudinally spaced circumferential drive bands each of which intersects the set of helical grooves in the rifle bullet, to define the pressure retaining formation.

19. The rifle bullet of claim 18, wherein the longitudinal body of the rifle bullet has one or more additional longitudinally spaced circumferential drive bands spaced between the at least two longitudinally spaced circumferential drive bands.

20. The rifle bullet of claim 15, wherein a front drive band of the at least two drive bands is positioned on the bullet to correspond to a position proximate an opening of the cartridge case.

* * * * *